United States Patent [19]

Anzai

[11] 4,369,757

[45] Jan. 25, 1983

[54] PLASMA JET IGNITION SYSTEM

[75] Inventor: Makoto Anzai, Yokosuka, Japan

[73] Assignee: Nissan Motor Company, Limited, Yokohama, Japan

[21] Appl. No.: 238,092

[22] Filed: Feb. 25, 1981

[30] Foreign Application Priority Data

Feb. 29, 1980 [JP] Japan ..... 55-24968

[51] Int. Cl.[3] ..... F02P 3/08

[52] U.S. Cl. ..... 123/620; 123/654; 315/209 CD

[58] Field of Search ..... 123/605, 620, 640, 654, 123/143 B; 315/209 CD, 209 T, 209 SC

[56] References Cited

U.S. PATENT DOCUMENTS

| | | | |
|---|---|---|---|
| 2,977,506 | 3/1961 | Short et al. | 123/654 |
| 3,828,752 | 8/1974 | Hioki et al. | 123/640 |
| 3,842,818 | 10/1974 | Cowell et al. | 123/143 A |
| 3,919,993 | 11/1975 | Neuman | 123/620 |
| 3,921,605 | 11/1975 | Wyczalek | 123/143 B |
| 3,972,315 | 8/1976 | Munden et al. | 123/640 |
| 4,122,816 | 10/1978 | Fitzgerald et al. | 123/640 |
| 4,138,980 | 2/1979 | Ward | 123/143 B |
| 4,223,656 | 9/1980 | Hamley | 123/620 |
| 4,308,488 | 12/1981 | Imai et al. | 315/209 CD |

FOREIGN PATENT DOCUMENTS

| | | |
|---|---|---|
| 3015611 | 10/1980 | Fed. Rep. of Germany . |
| 1310499 | 3/1973 | United Kingdom . |
| 1410471 | 10/1975 | United Kingdom . |
| 1410472 | 10/1975 | United Kingdom . |
| 1480598 | 7/1977 | United Kingdom . |
| 2050501 | 1/1981 | United Kingdom . |

*Primary Examiner*—Charles J. Myhre
*Assistant Examiner*—Andrew M. Dolinar
*Attorney, Agent, or Firm*—Schwartz, Jeffery, Schwaab, Mack, Blumenthal & Koch

[57] ABSTRACT

A plasma jet ignition system with means for storing plasma ignition electric energy is disclosed wherein a switching means responsive to an ignition timing signal is connected between a charging terminal of a capacitor of the storing means. A plasma ignition electric charge stored in the capacitor is discharged when the switching means is operated in accordance with the ignition timing signal, thereby preventing an irregular discharge of the stored plasma ignition electric energy during each ignition timing interval.

5 Claims, 6 Drawing Figures

PLASMA JET IGNITION SYSTEM

BACKGROUND OF THE INVENTION

1. Field of the Invention

The present invention relates to a plasma jet ignition system.

2. Description of the Prior Art

Most internal combustion engines have a spark ignition system for igniting the combustion chamber charge.

However, spark ignition systems have a problem in that the spark produced across the spark plug electrodes frequently fails to ignite the combustion charge.

In order to solve this problem and to provide improved ignition performance, a plasma jet ignition system is proposed wherein a plasma ignition current from a low tension electric power source is supplied to the spark plugs for propagating a plasma jet between spark plug electrodes, thereby improving the ignition performance.

As shown in FIG. 1, the conventional plasma jet ignition systems are provided with a high tension electric power source 1 for supplying a spark ignition current to spark plugs P in a conventional manner, and a low tension electric power source 2 for supplying a low tension plasma ignition current having a low voltage (3kV) to the spark plugs P each time an ordinary spark discharge occurs.

The high tension electric power source 1 is constructed similarly to conventional spark ignition system so that a high tension voltage is generated at a secondary winding of an ignition coil when contact points open at each time of ignition. This high tension secondary current is then delivered, in turn, to spark plugs P through a distributor 3, thereby causing spark discharge between spark plug electrodes.

The low tension electric power source 2 includes step-up means for producing a voltage of 3kV, such as a DC-DC converter.

The plasma ignition energy produced by this low tension electric power source 2 is accumulated in a capacitor C, then dumped into one of the spark plugs P. More specifically, the electric charge of the capacitor C is always applied to the spark plugs P through the diodes D, and it is discharged through one of spark plugs P to which the spark ignition current is supplied. The charge on the capacitor C is automatically discharged through the spark plug electrodes due to the dielectric breakdown between the spark plug electrodes caused by ordinary spark discharge. As a result of this selective discharge of the plasma ignition energy, the diodes D can be connected directly to the spark plugs P without passing through the distributor 3.

In short, in this plasma ignition system the plasma ignition energy is directly applied to the spark plugs P and the plasma ignition energy is discharged by dielectric breakdown across the spark plug electrodes of the spark plug to which the high tension spark ignition current is supplied.

However, in a case of the plasma ignition system constructed as above, there is a problem in that the electric energy of the capacitor C is often discharged prior to the optimum ignition timing, which is often referred to as an "irregular discharge".

The irregular discharge is due to a reduction in the dielectric breakdown voltage across the spark plug electrodes. The dielectric breakdown voltage varies as a function of the pressure within the combustion chamber; it has a minimum value during intake stroke of the engine. Therefore, a discharge of the plasma ignition energy may frequently occur prior to the spark discharge of the high tension ignition current.

Once this irregular discharge occurs, the charging of the capacitor C becomes insufficient at the optimum ignition timing, rendering it impossible to propagate the plasma jet by the plasma ignition current. Moreover, if a spark caused by an irregular discharge is produced during the induction stroke, a backfire may result.

SUMMARY OF THE INVENTION

According to the present invention, a plasma jet ignition system comprises means for generating an ignition timing signal and a plasma energy storing capacitor connected between a low tension electric power source and spark plugs through diodes, wherein a switching means is provided for grounding the capacitor in synchronism with the ignition timing signal. Thus the electric energy stored in the capacitor is discharged to spark plugs in response to the ignition timing signal.

An object of the invention therefore is to provide a plasma jet ignition system wherein the irregular discharge of the plasma ignition energy is prevented.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate several embodiments of the present invention and, together with the description, serve to explain the principles of the invention. In the drawings.

DETAILED DESCRIPTION OF PREFERRED EMBODIMENTS

Figure 1:
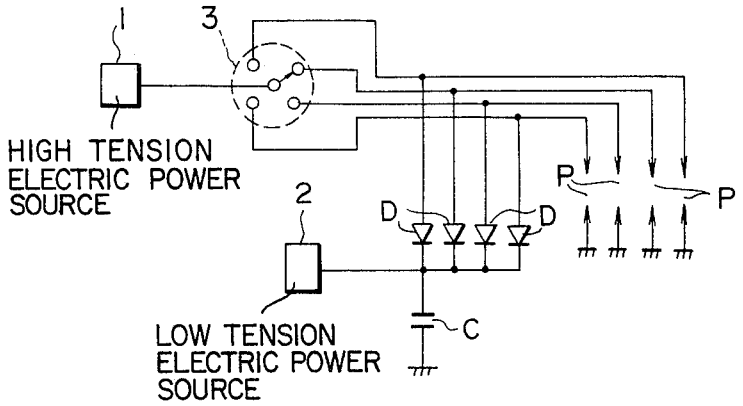
FIG. 1 PRIOR ART
FIG. 1 is a circuit diagram of a conventional plasma jet ignition system.
Figure 2:
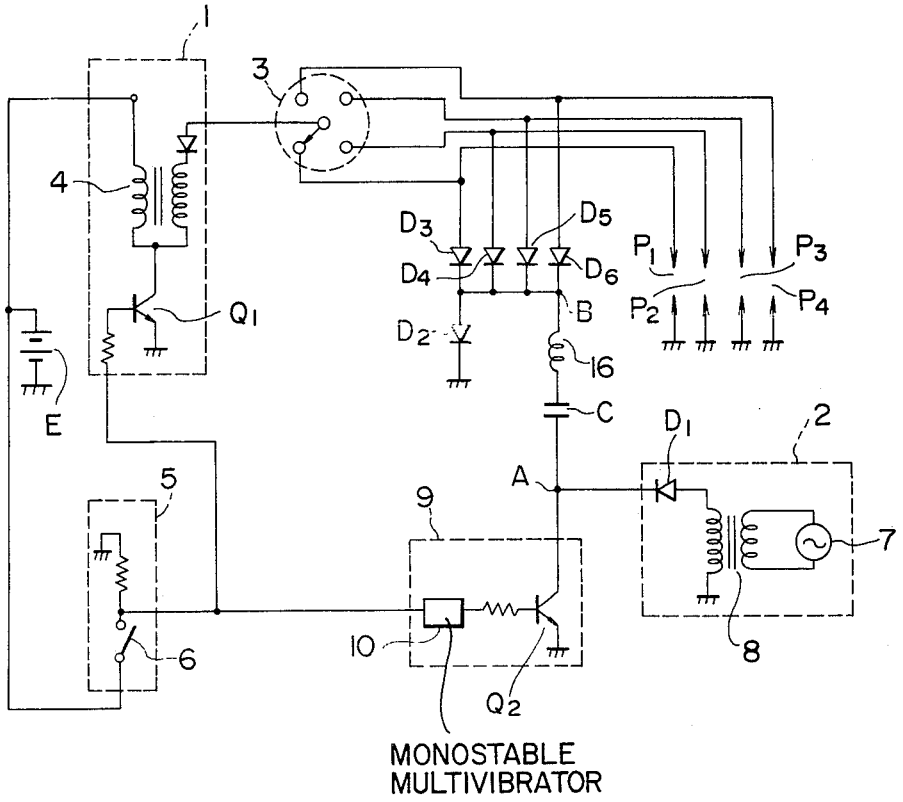
FIG. 2 is a circuit diagram of a first embodiment of a plasma jet ignition system according to the present invention.

As shown in FIG. 2, a plasma jet ignition system according to the present invention comprises a storage battery E, a high tension electric power source 1, a low tension electric power source 2, a distributor 3, spark plugs $P_1$ to $P_4$, diodes $D_1$ to $D_6$, a capacitor C, an ignition signal generator 5, and switching means 9.

The high tension electric power source 1 includes an ignition coil 4 and a transistor $Q_1$ for controlling the primary current for the ignition coil 4, and it produces a high tension secondary current each time the base current of the transistor $Q_1$ is cut off.

The on/off operation of this transistor $Q_1$ is controlled by the ignition signal generator 5, including contact points 6 which open and close in synchronism with the operation of the distributor 3, and the base current of the transistor $Q_1$ is cut off by the opening of the contact points 6 at each ignition timing.

FIG. 2 shows a state where the transistor $Q_1$ is cut off by the opening of the contact points 6, and the high tension ignition current flows from the ground through the spark plugs $P_1$ to $P_4$, distributor 3, and through a secondary winding of the ignition coil 4.

The low tension electric power source 2 includes an alternate current generator 7 and a step-up transformer 8 for boosting the output voltage of the alternate current generator 7, for example, to a voltage of 3kV. The output secondary current of the step-up transformer 8 is rectified by a diode $D_1$ for generating a DC charging current for the capacitor C.

A terminal A of the capacitor C is connected to the output terminal of the low tension electric power source 2, and the other terminal of the capacitor C is connected to a junction B of the cathodes of the diodes $D_3$ to $D_6$ and the anodes of the diode $D_2$ through a choke coil 16.

The anode terminals of the diodes $D_3$ to $D_6$ are respectively connected to the spark plugs $P_1$ to $P_4$ and the cathode terminal of the diode $D_2$ is connected to the ground. The charging circuit of the capacitor C is completed through this diode $D_2$, and the charging current flows from the low tension electric power source 2 through the capacitor C and through the diode $D_2$.

The terminal A of the capacitor C is also connected to the ground through a switching means 9.

The switching means 9 includes a monostable multivibrator 10 for producing a predetermined voltage during a short period after the entrance of an input signal, and a transistor $Q_2$ which turns on in accordance with the output voltage of the monostable multivibrator 10 as a source of the base current thereof. When the transistor $Q_2$ turns on, the charging terminal A of the capacitor C short-circuits to the ground.

The monostable multivibrator 10 is controlled in accordance with the output signal of the aforementioned ignition signal generator 5, and produces a high level output signal during a predetermined period (equal to and/or greater than an ordinary plasma discharge time, for example, from several to several hundred micro seconds) after opening of the contact points 6 which drive the transistor $Q_2$.

Figure 3:
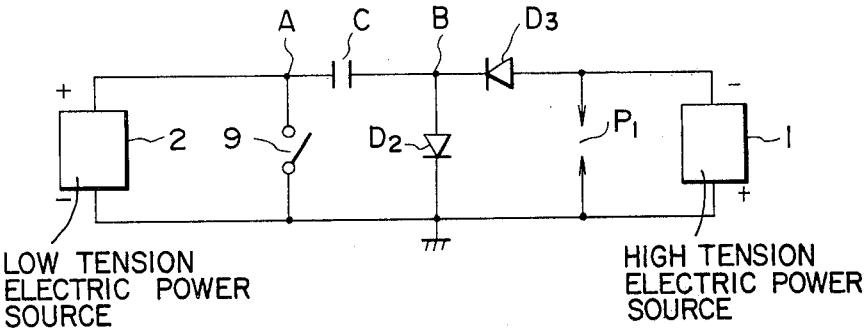
FIG. 3 is a simplified circuit diagram of FIG. 2.

Referring next to FIG. 3, there is depicted a simplified form of the circuit of FIG. 2, the operation of which will now be explained.

The low tension electric power source 2 supplies a charging current to the capacitor C, except during an ignition event. This charging current flows from the low tension electric power source 2 through the capacitor C, and through the diode $D_2$ to the ground.

Thus, assuming the output voltage of the low tension electric power source is +3kV, the potential at the terminal A of the capacitor C has a value of +3kV, and the potential at the junction B is equal to the forward voltage drop value (about 1V) of the diode $D_2$.

When an ignition even occurs, the switching means 9 closes and causes the potential at the terminal A to go to zero (ground).

Due to this change in potential at terminal A, a potential of −3kV is produced at junction B.

Accordingly, the electric energy stored in the capacitor C is discharged through the electrodes of spark plug $P_1$ which is then supplied with a high tension ignition current (from distributor 3), which causes a dielectric breakdown to occur between the electrodes of the plug $P_1$. The plasma ignition current flows from the spark plug $P_1$ into the capacitor C through the diode $D_3$ causing a plasma discharge to occur.

According to this embodiment, the electric charge stored in the capacitor C is not discharged until the switching means 9 closes in accordance with the ignition signal. Thus, the occurrence of an irregular discharge is prevented and a steady plasma ignition is performed.

Figure 4:
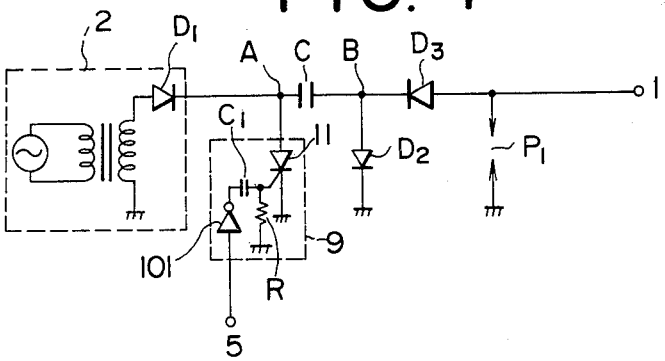
FIGS. 4 and 5 are simplified circuit diagrams of a second and a third embodiments of a plasma jet ignition system according to the present invention.

Referring to FIG. 4, a second embodiment according to the present invention is depicted.

This embodiment is characterized by the use of a switching means including a thyristor for controlling the charging current of the capacitor.

The switching means 9 comprises an inverter 101, a differentiating circuit having a capacitor $C_1$ and a resistor R, and a thyristor 11, the gate of which is connected to the output signal of the differentiating circuit. When the thyristor 11 turns on, the terminal A is short-circuited to the ground and a negative voltage is produced at the terminal B.

The differentiating circuit limits the time for applying the gate voltage. This time duration is minimized so that the thyristor 11 turns off automatically after the discharge of the capacitor C, so as to shorten the time duration where the low tension electric power source 2 is short-circuited.

Other circuit portions in this embodiment are denoted by the same reference numerals used in FIG. 2, and the explanation thereof is omitted since the operation thereof is substantially the same as the previous embodiment.

Figure 5:
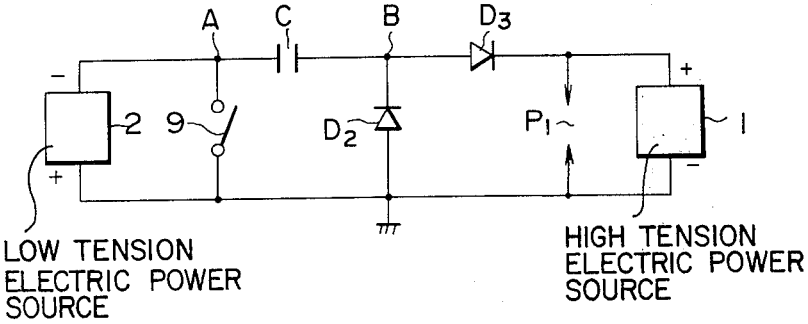

Referring to FIG. 5, a third embodiment according to the present invention is depicted.

This embodiment features a positive polality output voltage for accommodating an ignition system having a positive high tension spark ignition potential.

According to this embodiment, when the capacitor C has been charged by the low tension electric power source 2, the potential at the terminal A has the value of −3kV (assuming the output voltage of the low tension electric power source is −3kV) and this potential turns to zero when the switching means closes.

With this change in potential at the terminal A, the potential of the junction B rises up to +3kV, and the current flows from the capacitor C through the diode $D_3$, through the spark plug $P_1$ and to ground. Thus, the plasma ignition is effected by the positive charging current.

As described in the above, the operation of this third embodiment is the same as the first and second embodiments, except for the direction of the flow of the plasma ignition current, thus, the occurrence of an irregular discharge is prevented and the steady plasma discharge is performed.

Figure 6:
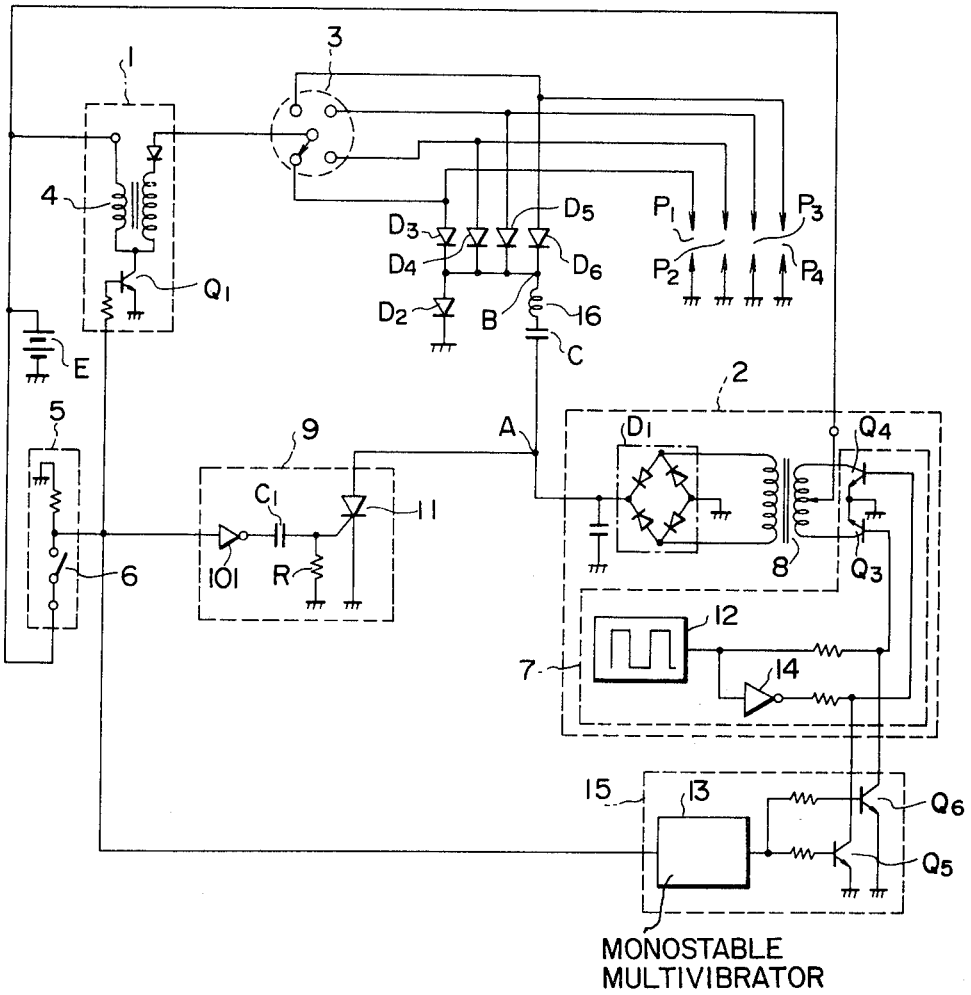
FIG. 6 is a circuit diagram of a fourth embodiment of a plasma jet ignition system according to the present invention.

Referring to FIG. 6, a fourth embodiment according to the present invention is depicted.

This embodiment is characterized by low tension electric power source including a pulse generator 12, an inverter 14, and a "stop" or switching circuit 15 including a monostable multivibrator 13. Other circuit portions of the system are substantially the same as the embodiments shown in FIGS. 2 and 4.

As is well known to those skilled in the art, once a thyristor turns on, it remains conductive unless the power current ceases. In this case, the thyristor 11 continues to be conductive since the current from the low tension electric power source 2 remains connected after plasma discharge occurs. In order to cause the thyristor 11 to case conduction, the operation of the low tension power source 2 is stopped for a predetermined period after the occurence of a signal from the signal generator 5 by means of monostable multivibrator 13.

The low tension power source 2 of this embodiment is constructed so that the primary winding of the step-up transformer 8 is supplied with a drive current by a pair of transistors $Q_3$ and $Q_4$ which conduct alternatively in accordance with a driving current from a pulse generator 12. Inverter 14 is interposed between the base of the transistor $Q_4$ and the pulse generator 12. The transistor $Q_4$ is supplied with the inverted current from the output of the pulse generator 12. A pair of switching transistors $Q_5$ and $Q_6$ are interconnected between the base of the transistors $Q_4$ and $Q_3$ respectively and ground for short-circuiting the base currents of transistors $Q_3$ and $Q_4$ in order to stop their operation in accordance with the output signal of the monostable multivibrator 13. Thus, the output of the low tension power source 2 ceases for a predetermined period in accordance with the output signal of the monostable multivibrator 13.

It will be appreciated from the foregoing, that according to the present invention, a switching means, operating in synchronism with the ignition timing signal, is provided to periodically ground a plasma energy storing capacitor to prevent irregular discharge of plasma ignition current. Thus, a steady and effective plasma ignition is performed.

The foregoing description of the preferred embodiments of the invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A plasma jet ignition system comprising:

a plurality of spark plugs;

means for generating an ignition timing signal;

a high tension electric power source;

a device connected to said high tension electric power source and said plurality of spark plugs for supplying a spark ignition current to said spark plugs selectively in accordance with said ignition timing signal;

a low tension electric power source;

a first diode;

a plurality of second diodes corresponding in number to said plurality of spark plugs;

a plasma energy storing capacitor having one terminal connected to said low tension electric power source and its other terminal connected to ground via said first diode and to said plurality of spark plugs via said plurality of second diodes, respectively; and switching means connected to said one terminal of said capacitor for grounding said one terminal in synchronism with said ignition timing signal so as to discharge electric energy stored in said capacitor to supply a plasma ignition current to that one of said plurality of spark plugs which is supplied with said spark ignition current in accordance with said ignition timing signal.

2. The plasma jet ignition system of claim 1, wherein said switching means includes a monostable multivibrator for producing an output signal in response to the ignition timing signal and a switching transistor having a base connected to the output signal of said monostable multivibrator, for connecting said one terminal of said capacitor to ground.

3. The plasma jet ignition system of claim 1, wherein said switching means includes an inverter for producing an output signal having a predetermined pulse width in response to said ignition timing signal and a thyristor connected to the output signal of said inverter as the trigger signal thereof for connecting said one terminal of said capacitor to ground.

4. The plasma jet ignition system of claim 1 or 3, including stop means for causing said low tension electric power source to cease its operation for a predetermined period after the occurrence of said ignition timing signal.

5. The plasma jet ignition system of claim 4, wherein said stop means includes a monostable multivibrator for producing an output signal in response to the ignition timing signal and a switching transistor responsive to the output signal of said monostable multivibrator for rendering said stop means inoperative.

* * * * *